United States Patent [19]

Weyer

[11] 4,274,329

[45] Jun. 23, 1981

[54] ROTARY ACTUATOR APPARATUS

[76] Inventor: Paul P. Weyer, 48811 284th S.E., Enumclaw, Wash. 98022

[21] Appl. No.: 960,044

[22] Filed: Nov. 13, 1978

[51] Int. Cl.[3] ..... F01B 3/08; F01B 21/02

[52] U.S. Cl. ..... 92/33; 92/61; 92/136; 414/735

[58] Field of Search ..... 92/2, 33, 31, 61, 136; 91/61; 74/30; 414/744 R, 730, 735, 772, 774, 705, 4; 173/108

[56] References Cited

U.S. PATENT DOCUMENTS

| | | | |
|---|---|---|---|
| 2,474,336 | 6/1949 | Stone | 92/61 X |
| 2,970,442 | 2/1961 | Taylor | 92/136 X |
| 3,020,012 | 2/1962 | Moracco et al. . | |
| 3,141,387 | 7/1964 | Geyer | 92/33 |
| 3,200,964 | 8/1965 | Eldred | 414/772 X |
| 3,213,923 | 10/1965 | Richter | 92/33 X |
| 3,260,376 | 7/1966 | Stoll | 91/61 X |
| 3,288,035 | 11/1966 | Ryzner | 92/136 |
| 3,339,463 | 9/1967 | Updegrave | 92/31 |
| 3,463,336 | 8/1969 | Mork | 414/705 X |
| 3,563,321 | 2/1971 | Barendsen | 173/43 |
| 3,759,563 | 9/1973 | Kitamura | 414/4 X |

*Primary Examiner*—Irwin C. Cohen

*Attorney, Agent, or Firm*—Seed, Berry, Vernon & Baynham

[57] ABSTRACT

A rotary actuator apparatus provides compound rotation at its output in two planes perpendicular to one another. This compound rotation is utilized in positioning a workpiece or in positioning a rock drill on the boom of a vehicle. A rotary rack and pinion actuator has an output pinion shaft rotatably mounted in an external housing and a piston driven rack in a cylinder at right angles to the output shaft housing. This cylinder is welded to the output shaft housing so that the cylinder can transmit rotational torque to the output shaft housing.

7 Claims, 3 Drawing Figures

ROTARY ACTUATOR APPARATUS

BACKGROUND OF THE INVENTION

1. Field of the Invention

This invention relates to rotary actuators, particularly compound rotary actuators in which the final output member can be rotated in two planes perpendicular to one another. A specific application is rotary actuators of the compound motion type used in conjunction with an industrial robot for handling worpieces or with a boom supported rock drill apparatus for positioning the rock drill on the vehicle.

2. Description of the Prior Art

Rotary actuators in their most simple form frequently employ a piston powered rack which is reciprocally mounted in a cylinder and which meshes with a pinion secured to an output shaft which is rotatably mounted in a second cylinder or external output shaft housing. Conventionally, the rack enclosing cylinder is threaded into the output shaft housing. This provides a very easy to manufacture actuator but has disadvantages. The threaded connection between the rack enclosing cylinder and the output shaft housing is by virtue of its threads unable to transmit torque in two directions.

Mobile rock drilling apparatus have the requirement that the drilling head mounted on the end of an articulated boom be rotatable in two planes of motion at right angles to one another. That is, the rock drill head must be rotated, for example, in a horizontal plane and also rotated or flipped over in a vertical plane. Even more important applications for compound rotary actuators are workpiece handling devices or robots for remotely manipulating objects. Conventionally, this compound rotation is provided by plural cylinder and piston actuators such as shown in U.S. Pat. No. 3,020,012. These cylinder piston actuators are expensive to maintain, cumbersome to utilize and are expensive to manufacture.

SUMMARY OF THE INVENTION

It is an object of this invention to provide a simplified rack and piston actuator which can transmit rotational torque in either direction between the cylinder which contains the rack and the housing for the output pinion shaft.

It is another object of this invention to provide the welded type rack and pinion rotary actuator with a direct connection between the cylinder for the rack and the output shaft of a second rotary actuator of the helical spline type.

It is still a further object of this invention to provide a compound motion actuating apparatus utilizing a helical spline actuator coupled to a rack and pinion actuator with torque transmitted from the helical actuator directly to the rack and pinion actuator for use with a workpiece manipulating robot, rock drilling head or the like.

DETAILED DESCRIPTION OF THE PREFERRED EMBODIMENTS

Figure 3:
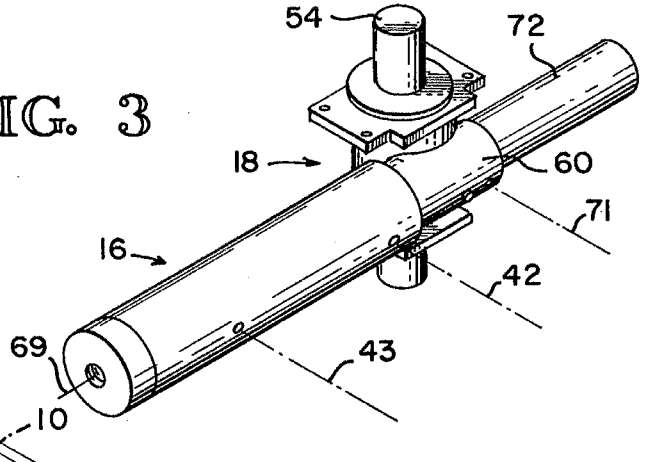
FIG. 3 is a fragmentary isometric of a rack and pinion rotary actuator embodying the principles of the invention.
Figure 1:
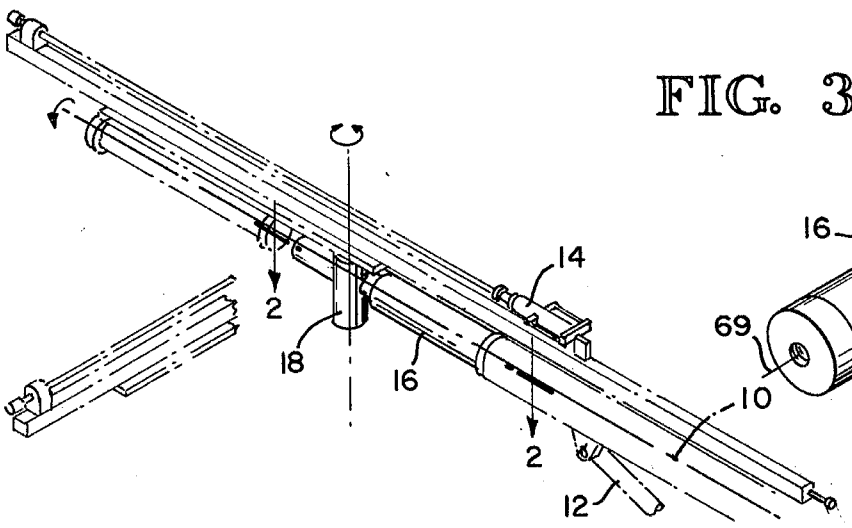
FIG. 1 is a schematic isometric of a rock drilling apparatus embodying the principles of the invention.
Figure 2:
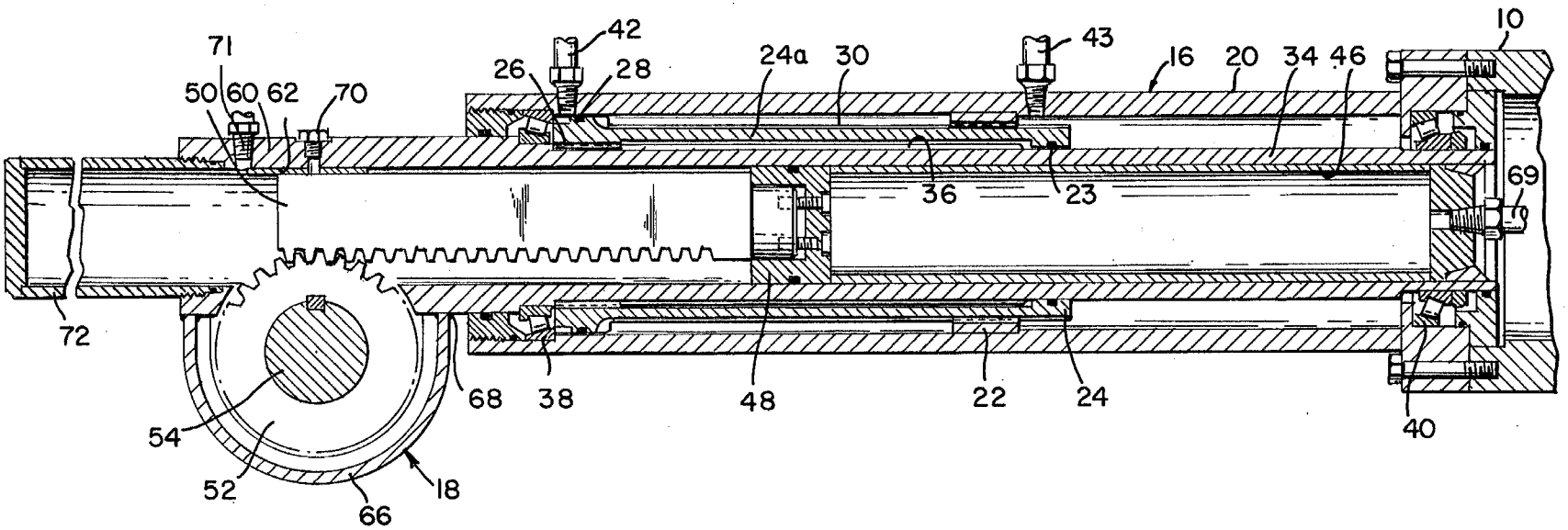
FIG. 2 is a longitudinal section taken along the line 2—2 of FIG. 1.

As best shown in FIG. 1, a typical rock drill apparatus of the type shown in U.S. Pat. No. 3,020,012 includes a boom or base 10 articulated by a cylinder and piston 12 and manipulated as is shown in the patent. (While the invention is also used for workpiece manipulating robots the rock drill application hereindescribed is the best illustration presently available to describe the principles of the invention). At the outer end of this boom is a rock drill 14 which must be positioned within various directions in a horizontal plane or in a vertical plane. In this invention to provide this compound rotary motion, the drill is coupled to the boom 10 by a first rotary actuator 16 which in turn rotates a second rotary actuator 18.

The first rotary actuator is of the helical spline type and includes an outer or external housing 20 having a stationary spline ring 22. A piston 24 reciprocates within the housing 20 and is provided with sealing rings 23 and an elongated piston sleeve **24*a* which terminates at a second spline ring 26. The piston sleeve is also provided with sealing rings 28 at its opposite end. The piston sleeve is provided with elongated helical splines 30 which mesh with the spline ring 22 so that upon reciprocation of the piston 24** the piston sleeve rotates.

The piston 24 slides on a hollow output member 34 which is provided at a central portion with a second set of helical splines 36 that mesh with the second spline ring 26. Thus, as the piston reciprocates and rotates, it rotates the output member 34 but in addition a second rotational movement is added to the output member 34. While a single ring and spline arrangement can be used to achieve the benefits of this invention, it should be understood that the use of a double spline actuator enhances the rotational output of the first rotary actuator without substantially increasing the length of the actuator.

Suitable bearings 38 and 40 rotationally mount the output member 34 within the cylinder 20. Reciprocation of the piston 24 is effected by hydraulic sources 42 and 43.

It is a unique feature of this invention that the output member 34 being hollow can also be used as the cylinder for the rack and piston of the second actuator 18. A stop tube limits 46 reciprocation of a piston 48. The piston 48 is coupled to a gear rack 50 that meshes with a pinion 52 which is keyed to a pinion shaft or second output shaft 54. The rock drill 14 is secured to this second output shaft. The outer end of the rack moves in a cylinder 60 which is an integral part of the output member 34 and can be considered as merely an extension of the output member 34. A backup bearing 62 held by fastener 70 provides a reaction force to maintain the rack against the pinion 52. The pinion 52 is rotatably mounted in an external housing 66 which is uniquely welded as at 68 to the cylinder 60 or extension of the output member 34. In this manner the rotation of the output member 34 in either direction is transmitted to the external housing 66 which rotates the rock drill head in one rotational plane while the movement of the piston will rotate the output shaft 54 for movement of the drill head in a second plane at right angles to the first plane.

Hydraulic pressure for actuating the piston 48 is introduced by lines 69 and 71 with the remote end of the cylinder 60 being enclosed by a pressure cap 72.

The use of the hollow output member 34 as the cylinder for the piston of the rack and piston actuator 18 and the capability of transmitting the torque from this output member 34 to the outer housing 66 of the second actuator are uniquely combined to make a very compart, easy to manufacture and readily articulated positioning mechanism for compound motions.

While the preferred embodiments of the invention have been illustrated and described, it should be understood that variations will be apparent to one skilled in the art without departing from the principles. Accordingly the invention is not to be limited to the specific embodiments shown in the drawing.

I claim:

1. A compound rotary actuator apparatus for a workpiece manipulating robot, boom supported rock drill machine or the like having a member to be articulated and a frame, comprising:

a first rotary actuator having internal helical spline means, a first external cylindrical housing, an internal first output member, and first piston means operable for acting on said spline means to provide rotation of said output member about a first longitudinal axis of said first external cylindrical housing by reciprocation of said first piston means along said axis, a second rotary actuator coupled to said first rotary actuator and having a second external housing with a longitudinal axis coincident to said first axis, second piston means reciprocating within said second external housing along said longitudinal axis and a second output member rotatable in response to reciprocation of said second piston means about an axis perpendicular to the axis of rotation of said first output member, said second external housing coupled to said first output member for rotation therewith, means coupling said first external housing to a frame and means coupling said second output member to a member to be articulated whereby reciprocation of said first and second piston means will provide rotation of said articulated member about two right angle axes, said second output member being rotatably mounted in a third external housing, said second external housing being joined to said third external housing without threads by welding whereby the rotation of said first output member, which is directly transferred to said second external housing, will not release from said third external housing but will transmit the rotational torque in either direction to said third external housing.

2. The actuator apparatus of claim 1, said helical spline means including a first outer spline ring having internal helical teeth stationary on said first external housing, said first piston means having a piston and an elongated piston sleeve, said sleeve having first outer elongated helical splines meshing with the helical teeth of said first outer spline ring, said sleeve having an internal second spline ring having inner helical teeth, said first output member having outer elongated second helical splines meshing with the helical teeth of said second spline ring whereby reciprocation of said first piston means causes rotation of said sleeve and double rotation of said first output member relative to said first external housing.

3. The actuator apparatus of claim 1 or claim 2, wherein said second piston means includes a rack having gear teeth, said second output member having a pinion gear meshing with said teeth of said rack.

4. A compound rotary actuator having a first external cylindrical housing, first internal helical spline means, first piston means coupled to said spline means, and a first output member operable through said spline means upon reciprocation of said first piston means along a first axis for rotary motion about said first axis relative to said first external housing, a second external housing having a longitudinal axis coincident to said first axis, means joining said second external housing to said first output member, and said second external housing providing a cylinder, second piston means reciprocally mounted in said cylinder for movement along said longitudinal axis, a rack coupled to said second piston means, a second output member having a pinion gear meshed with said rack for rotation of said second output member upon reciprocation of said second piston means, said second output member being rotatably mounted in a third external housing for rotation about a second axis at right angles to said first axis, said second external housing and said third external housing being secured for transmission of torque in either direction therebetween.

5. The actuator of claim 4, said first output member being hollow, said second external housing being formed as an integral extension of said hollow first output member for providing a continuous cylinder for said second piston means.

6. The actuator of claim 4 or 5, said second and third external housings being welded together.

7. The actuator of claim 4 or 5 said first helical spline means including a first outer spline ring having internal helical teeth stationary on said first external housing, said first piston means having a piston and an elongated piston sleeve, said sleeve having first outer elongated helical splines meshing with the helical teeth of said outer spline ring, said sleeve having an internal second spline ring having inner helical teeth, said first output member having outer elongated second helical splines meshing with the helical teeth of said second spline ring whereby reciprocation of said first piston means causes rotation of said sleeve and double rotation of said first output member.

* * * * *